US006857854B2

(12) United States Patent
Pearce

(10) Patent No.: US 6,857,854 B2
(45) Date of Patent: Feb. 22, 2005

(54) QUICK CONNECT BLADE SYSTEM

(75) Inventor: Richard A. Pearce, Byhalia, MS (US)

(73) Assignee: Hunter Fan Company, Memphis, TN (US)

( * ) Notice: Subject to any disclaimer, the term of this patent is extended or adjusted under 35 U.S.C. 154(b) by 0 days.

(21) Appl. No.: 10/617,000

(22) Filed: Jul. 9, 2003

(65) Prior Publication Data

US 2004/0013527 A1 Jan. 22, 2004

Related U.S. Application Data

(60) Provisional application No. 60/395,869, filed on Jul. 12, 2002.

(51) Int. Cl.[7] ..... F04D 29/36

(52) U.S. Cl. ..... 416/207; 416/210 R; 416/214 R

(58) Field of Search ..... 416/5, 210 R, 416/204 R, 205, 206, 207, 214 R

(56) References Cited

U.S. PATENT DOCUMENTS

| | | | | |
|---|---|---|---|---|
| 5,110,261 A | | 5/1992 | Junkin | |
| 5,304,037 A | | 4/1994 | Scofield | |
| 5,464,323 A | | 11/1995 | Scofield | |
| 5,944,486 A | * | 8/1999 | Hodgkins, Jr. | 416/210 R |
| 5,944,487 A | | 8/1999 | Pearce | |
| 6,010,306 A | * | 1/2000 | Bucher et al. | 416/210 R |
| 6,352,409 B1 | * | 3/2002 | Blateri et al. | 416/207 |
| 6,371,729 B1 | * | 4/2002 | Tseng | 416/210 R |
| 6,382,917 B1 | | 5/2002 | Zuege | |

* cited by examiner

*Primary Examiner*—Christopher Verdier
(74) *Attorney, Agent, or Firm*—Baker Donelson

(57) ABSTRACT

A ceiling fan quick connect blade system (10) is disclosed which is coupled to a conventional ceiling fan electric motor (11) having a lower portion (12). The motor lower portion has an annular array of threaded mounting holes (13) therein. A post (16) having a stem (17) and a head (18) is mounted within each mounting hole (13) and extends through a S-shaped spring (19). The blade system also includes a blade iron (27) having a motor mounting flange (28) and a blade mounting portion (29). The blade mounting portion (29) has a pair of guide pins (41) extending above a peripheral, top edge 42, a rubber dampening plate (43) having protrusions (44) configured to nest upon the guide pins (41), and a securing plate (45) mounted for pivotal movement through a mounting bolt (46). The securing plate has a pair of oppositely facing catches (48) and an elongated tab (49) sized and shaped to be received within a notch (51). Each catch has an upright portion (53) and an overhanging portion (54). The securing plate is pivotal between a blade unlocked position and a blade locked position. Each blade iron is coupled to a ceiling fan blade 56 having a pair of mounting holes (57) and a pair of guide holes (58). The mounting holes (57) are sized and shaped to receive the blade iron catches (48). The guide holes (58) are sized and shaped to receive the dampening plate protrusions (44).

10 Claims, 7 Drawing Sheets

QUICK CONNECT BLADE SYSTEM

REFERENCE TO RELATED APPLICATION

Applicant claims the benefit of U.S. Provisional Patent Application Ser. No. 60/395,869 filed Jul. 12, 2002 and entitled QUICK CONNECT BLADE AND BLADE IRON.

TECHNICAL FIELD

This invention relates to ceiling blades, and especially to quick connecting blades.

BACKGROUND OF THE INVENTION

Electrically powered ceiling fans typically have a motor mounted within a stationary housing that is suspended from a ceiling. In operation, the motor rotates an annular array of individual extensions in the form of blade irons. Each blade iron is associated with a blade mounted thereto.

Ceiling fans are usually sold at retail with their blades packed separately from the blade irons and the blades packed separately from the motor for compactness. The housing is normally mounted in suspension from the ceiling through a downrod and then the blades are mounted to the blade irons and the blade irons are mounted to the motor.

The blades of ceiling fans are usually coupled to the blade irons by passing mounting screws through holes in the blade and into threaded holes in the blade iron. This task however can be difficult or tedious when the electric motor is already suspended from the ceiling. The difficulty is attributed to the fact that the mounting screws are usually passed from the top of the blade to hide the screw heads from view. The installer must align the holes in the blade with the holes in the blade iron while simultaneously passing the screws through the holes. The installer must do this from a position below the ceiling fan limiting the installer's ability to view the mounting holes and thus aligning the mounting holes and drivably rotate the screws.

Accordingly, it is seen that a need remains for a blade that can be quickly and easily mounted to a blade iron. It is to the provision of such therefore that the present invention is primarily directed.

SUMMARY OF THE INVENTION

In a preferred form of the invention a quick connect blade iron comprises a blade having a pair of mounting holes therethrough, the blade iron having a motor mounting portion, a blade mounting portion and a mounting plate coupled to the blade mounting portion. The mounting plate has a pair of catches sized and shaped to pass through the blade mounting holes and be pivoted relative to the blade mounting portion between an unlocked position allowing the passage of the catches through the mounting holes and a locked position wherein the catches capture the blade. With this construction, with the mounting plate in its unlocked position the blade is mounted to the blade iron by positioning the blade against the blade iron and passing the catches through the mounting holes, the mounting plate is then rotated to its locked position to lock the blade to the blade iron.

DETAILED DESCRIPTION

Figure 1:
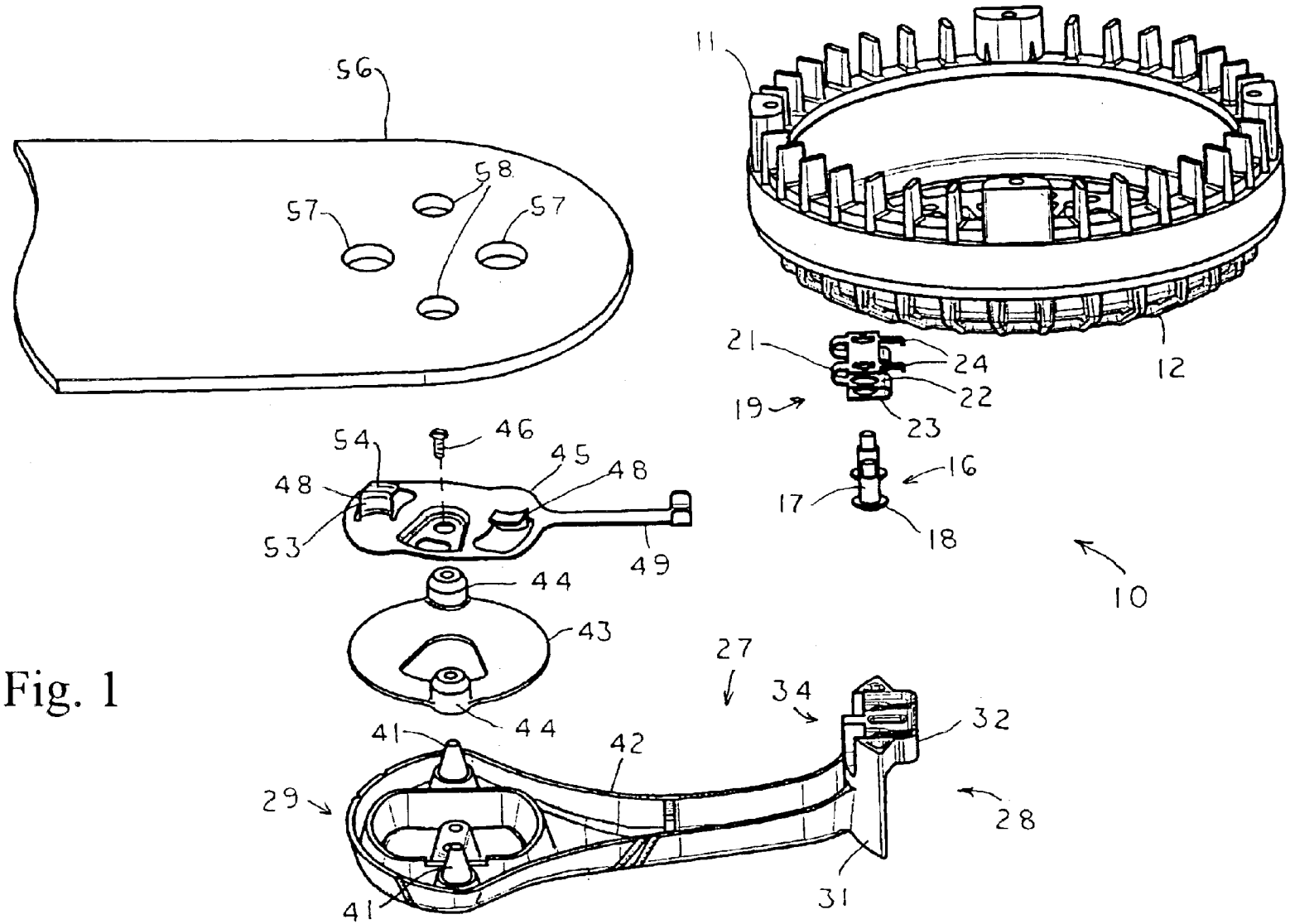
FIG. 1 is an exploded view of a portion of a ceiling fan motor, ceiling fan blade iron and ceiling fan blade embodying principles of the invention is a preferred form.
Figure 2:
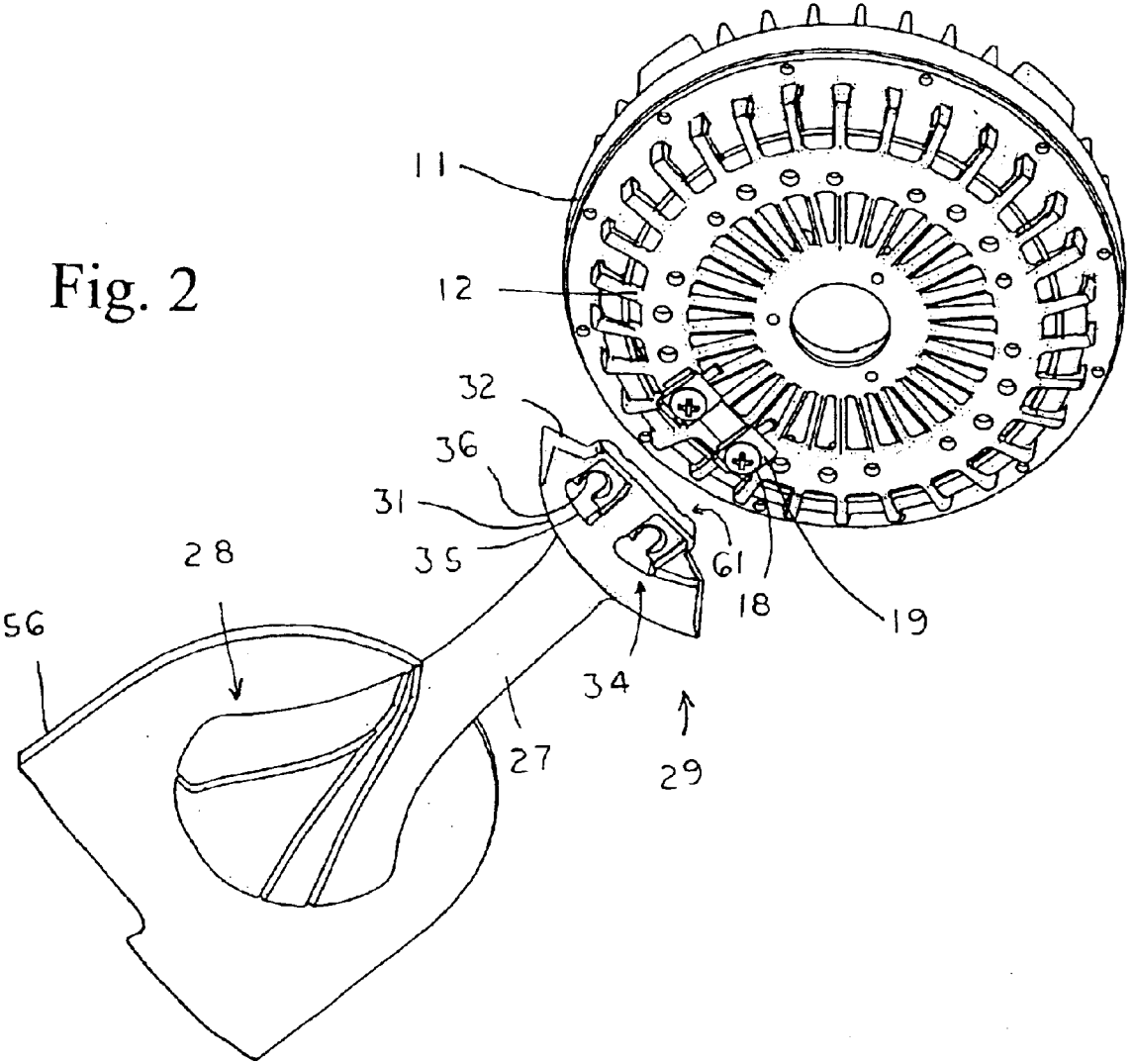
FIGS. 2–4 are a series of perspective views of the ceiling fan blade iron and blade shown being connected to the motor portion.

With reference next to the drawings, there is shown a quick connect blade system 10 in a preferred form of the invention. The blade system 10 is coupled to a conventional ceiling fan electric motor 11 having a lower portion 12. The motor lower portion 12 has an annular array of five, paired, internally threaded mounting holes 13 therein. A post or mounting screw 16, having a stem 17 and a head 18, is mounted within each mounting hole 13. Each post 16 passes through a S-shaped spring 19 having a first leg 21 adjacent the motor lower portion 12, a second leg 22 and a third leg 23. The first leg 21 is configured to include two L-shaped flanges which forms a releasable blade iron stop 24.

The blade system 10 also includes a blade iron 27 having a motor mounting flange or portion 28 and a blade mounting portion 29. The motor mounting portion 28 has a vertical portion or peripheral wall 31 extending to a horizontal portion or abutment wall 32 which abuts the motor lower portion 12. The motor mounting portion 28 has a pair of slots 34 each of which has an enlarged, peripheral portion 35 that extends through the vertical portion 31 to a narrow, inboard portion 36 that extends through the horizontal portion 32. The horizontal portion 32 also includes a recess or groove 37 positioned about each narrow portion 36. Each slot 34 is configured to allow the passage of the post head 18 through the enlarged portion 35 and the post stem 17 into the narrow portion 36.

Figure 5:
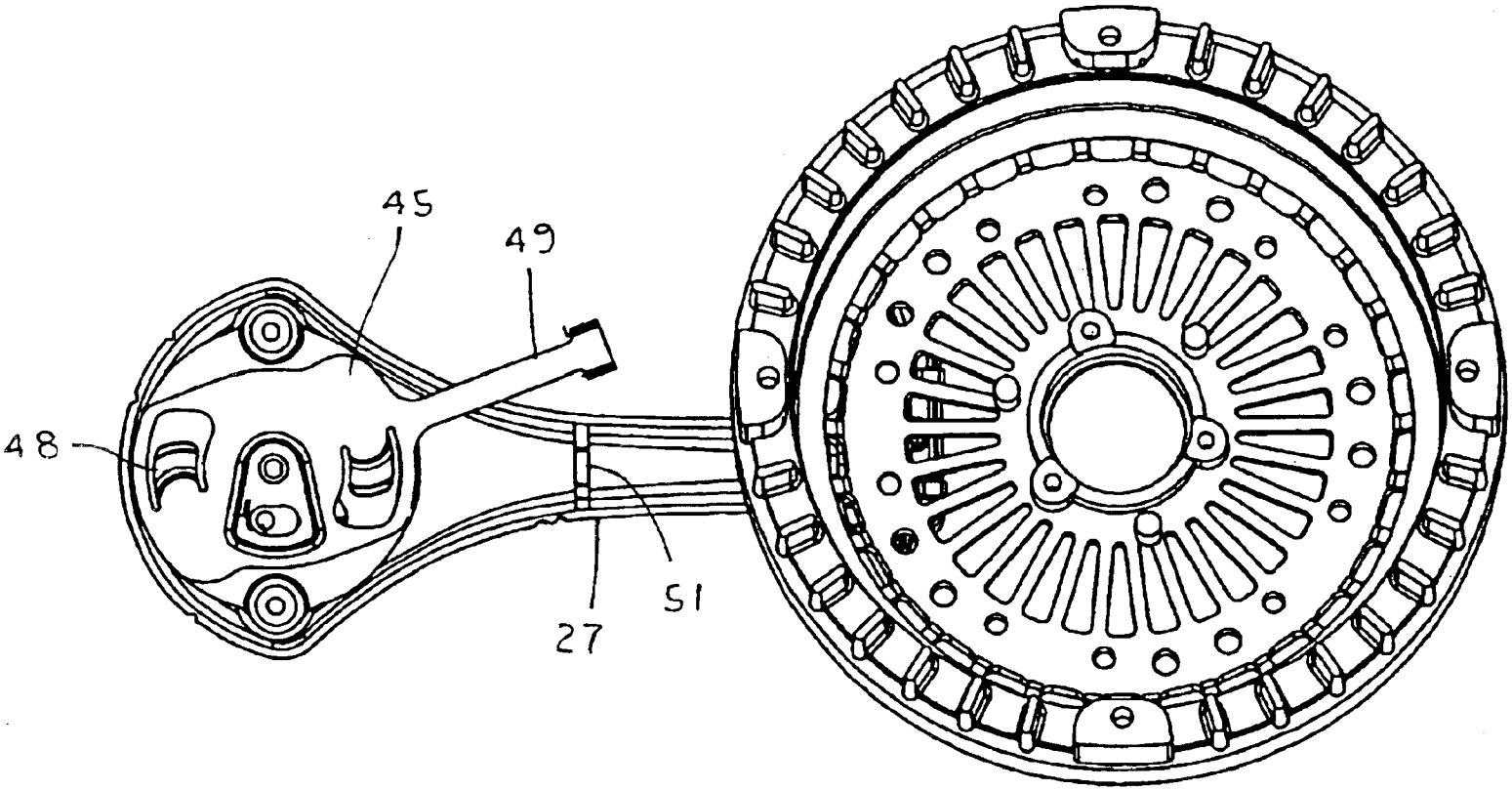
FIGS. 5 and 6 are top views showing the ceiling fan blade iron connected to the motor portion.
Figure 6:
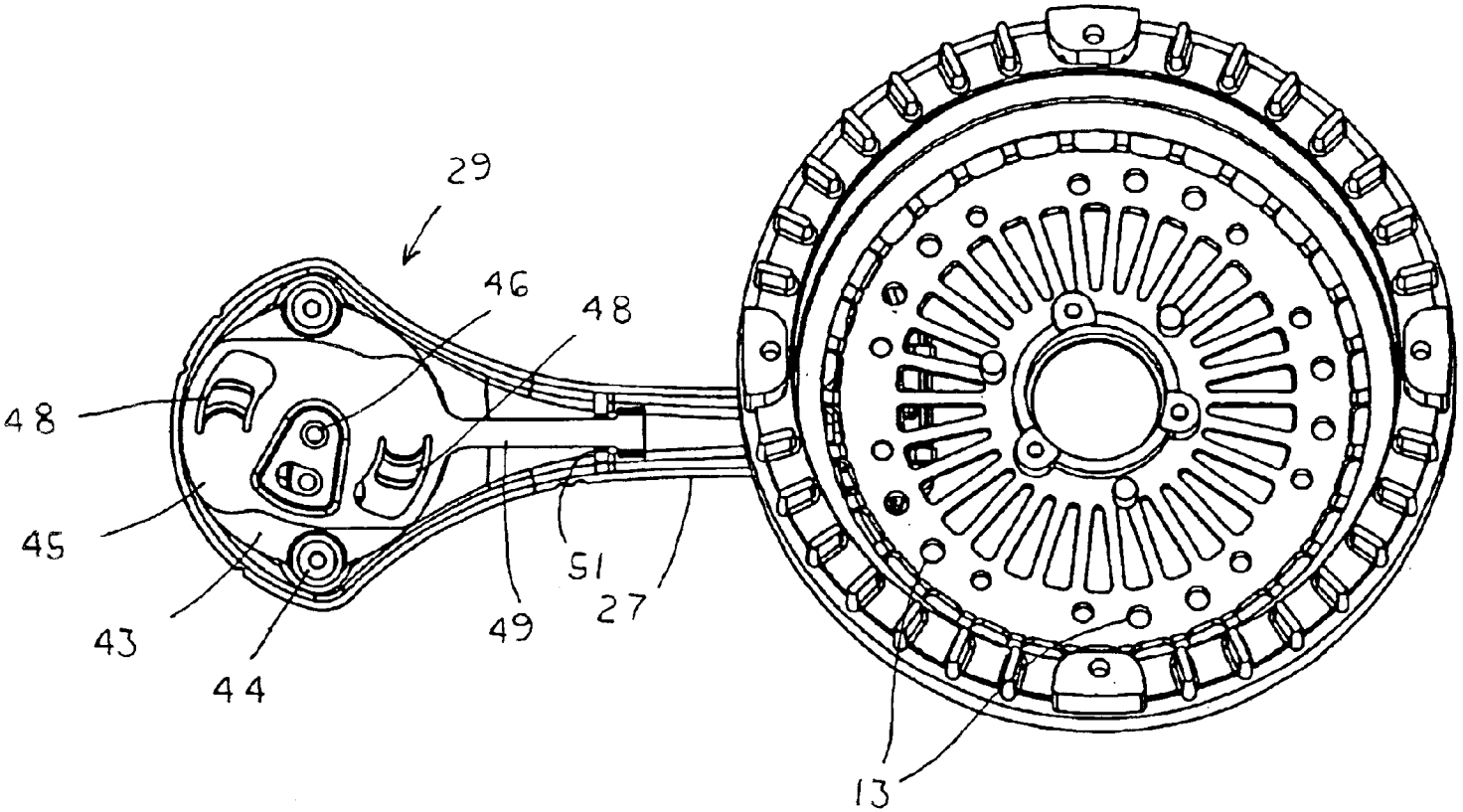
Figure 7:
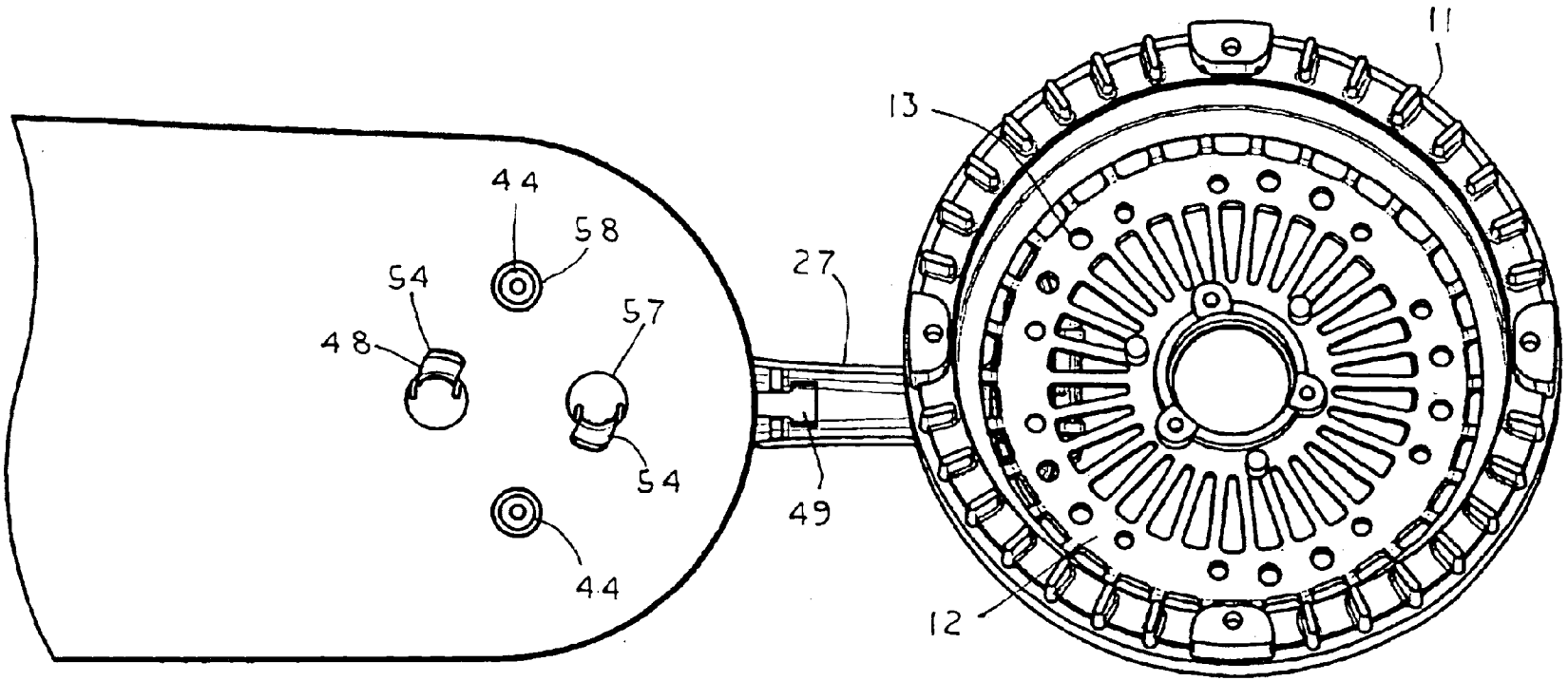
FIG. 7 is a top view of the ceiling fan blade iron connected to a blade.

The blade mounting portion 29 of the blade iron has a pair of stationary guide pins 41 extending above a peripheral, top edge 42, a rubber dampening plate 43 having stationary protrusions 44 configured to nest upon the guide pins 41, and a mounting or securing plate 45 mounted for pivotal movement through a mounting bolt 46. The securing plate 45 has a pair of oppositely facing catches 48 and an elongated tab 49 sized and shaped to be received within a detent or notch 51 extending from the top edge 42 of the blade iron. Each catch 48 has an upright portion 53 and an overhanging portion 54. The securing plate 45 is pivotal between a blade unlocked position, shown in FIG. 5, and a blade locked position, shown in FIG. 6.

Each blade iron 27 is coupled to a ceiling fan blade 56. Each ceiling fan blade 56 has a pair of mounting holes 57 and a pair of guide holes 58. The mounting holes 57 are sized and shaped to receive the blade iron catches 48. The guide holes 58 are sized and shaped to receive the dampening plate protrusions 44. The thickness of the blade 56 is such that the blade fits snugly between the top edge 42 of the blade iron and the overhanging portion 54 of the catch 48.

In use, with the securing plate 45 is in its unlocked position, the blade 56 may be quickly attached to the blade iron 27 by passing the securing plate catches 48 through the blade mounting holes 57 and passing the dampening plate protrusions 44 through the blade guide holes 58. An operator then grasps the elongated tab 49 and therethrough rotates the securing plate 45 to its locked position, shown in FIG. 6. With the securing plate 45 in its locked position the catches upright portions 53 abut the side walls of the mounting holes 57 and the overhanging portions 54 are pressed against the top surface of the blade 56. As such, the catches capture the blade and prevent any blade movement relative to the blade iron. The positioning of the protrusions 44 within the guide holes 58 prevent relative movement between the blade 56 and the blade iron 27. Of course, the dampening plate 43 is utilized to minimize vibration and noise between the blade and the blade iron. The securing plate 45 is prevented from moving back towards its unlocked position by the positioning of the elongated tab 49 within the notch 51. Of course the securing plate may be manually moved back to its unlocked position by lifting and flexing the tab 49 upwards and out of the notch 51 should it be desired to later remove the blade from the blade iron.

Figure 3:
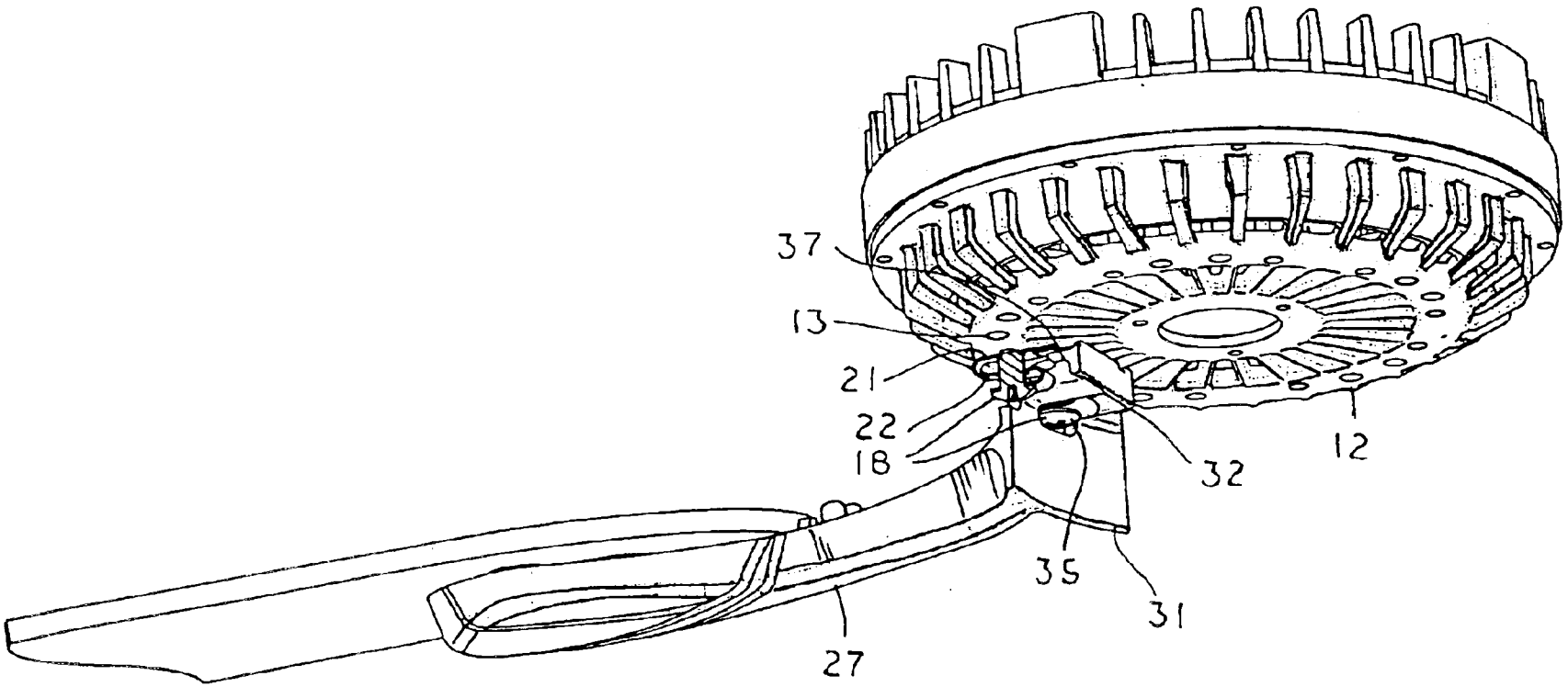
Figure 4:
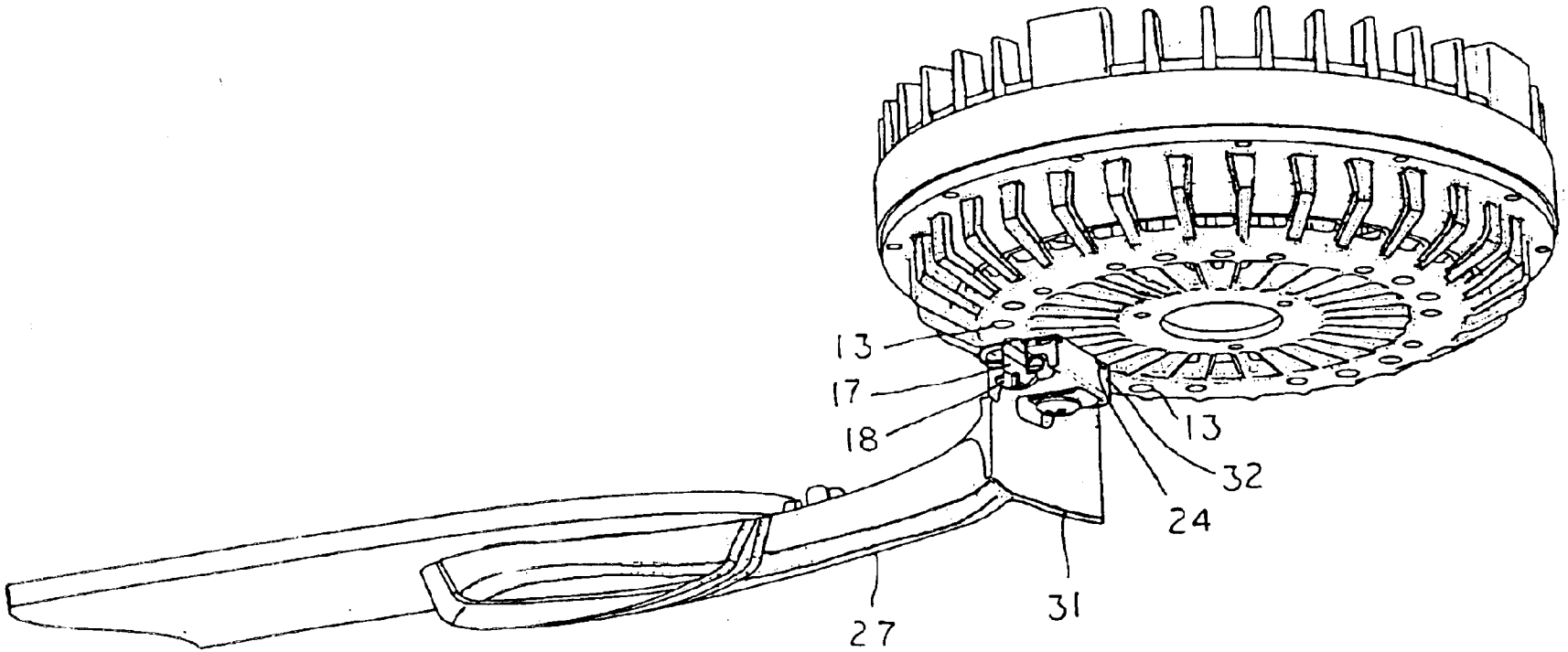

The operator may then mount the blade iron 27 to the motor lower portion 12 by guiding the blade iron so that the slots 34 are aligned with the posts 16. The blade iron 27 is then moved in an outboard direction so that the blade iron horizontal portion 32 is forced into the space between the spring first leg 21 and the spring second leg 22, as shown in FIG. 3. The blade iron is in its final position when the stops 24 spring upwards and abut the inboard side of the horizontal portion 32, as shown in FIG. 4, to prevent the inboard movement of the blade iron relative to the motor. The biasing force of the springs 19 capture securely the blade iron motor mounting portion 28 and thereby couple the blade iron to the motor.

The blade iron motor mounting portion 28 may include a recess or groove 61 sized and shaped to receive a portion of the spring stops 24 in order to provide flush mounting of the blade iron against the motor lower portion 12.

It thus should be understood that the blade may be quickly and easily mounted to the blade iron. Similarly, it should be understood that the blade iron may be quickly and easily mounted to the motor with a single outboard movement of the blade iron.

It should also be understood that the present invention is not limited to use with ceiling fans, and may be utilized with any type of fan.

It should also be understood that all references to the directional terms such as vertical, horizontal, upright and the like are for illustrative purposes only with reference to the drawings.

It thus is seen that a blade iron is now provided which may be mounted quickly and easily and thus overcomes problems with those of the prior art. While this invention has been described in detail with particular references to the preferred embodiments thereof, it should be understood that many modifications, additions and deletions, in addition to those expressly recited, may be made thereto without departure from the spirit and scope of the invention as set forth in the following claims.

What is claimed is:

1. A quick connect blade iron comprising;

a blade having a pair of mounting holes therethrough; and a blade iron having said motor mounting portion, a blade mounting portion and a mounting plate coupled to said blade mounting portion, said mounting plate having a pair of catches sized and shaped to pass through said blade mounting holes and be pivoted relative to said blade mounting portion between an unlocked position allowing the passage of said catches through the mounting holes and a locked position wherein said catches capture said blade, whereby with the mounting plate in its unlocked position the blade is mounted to the blade iron by positioning the blade against the blade iron and passing the catches through the mounting holes, and the mounting plate is then rotated to its locked position to lock the blade to the blade iron.

2. The quick connect blade iron of claim 1 wherein said catches have an upright portion and an overhanging portion whereby the blade is captured between said overhanging portion and said blade mounting portion.

3. The quick connect blade iron of claim 1 wherein said mounting plate includes a tab and wherein said blade iron includes a detent configured to engage said tab.

4. The quick connect blade iron of claim 3 wherein said detent is a notch.

5. The quick connect blade iron of claim 1 wherein said blade iron mounting portion further includes at least one stationary protrusion and wherein said blade includes a protrusion hole configured to mate with said protrusion.

6. In combination with a fan having an electric motor, a plurality of blade irons and a plurality of blades, the improvement which comprises:

a quick connect blade system having two mounting holes extending through the blade and a mounting plate coupled to said blade iron for pivotal movement about a pivot, said mounting plate having two catches positioned upon opposite sides of said pivot, said catches being configured to pass through said mounting holes and to be moved into engagement with said blade, whereby the blade may be coupled to the blade iron by passing the catches through the blade holes and then pivoting the mounting plate to move the catches into engagement with the blade.

7. The improvement of claim 6 wherein said catches have an upright portion and an overhanging portion whereby the blade is captured between said overhanging portion and said blade mounting portion.

8. The improvement of claim 6 wherein said mounting plate includes a tab and wherein said blade iron includes a detent configured to engage said tab.

9. The improvement of claim 8 wherein said detent is a notch.

10. The improvement of claim 6 further includes at least one protrusion and wherein said blade includes a protrusion hole configured to mate with said protrusion.

* * * * *